United States Patent [19]

Pitts, Jr. et al.

[11] 3,979,716

[45] Sept. 7, 1976

[54] MEANS AND METHOD FOR TRANSMITTING A HIGH COUNT RATE PULSE SIGNAL OVER A COMMON WELL LOGGING CABLE

[75] Inventors: Robert W. Pitts, Jr.; Houston A. Whatley, Jr., both of Houston, Tex.

[73] Assignee: Texaco Inc., New York, N.Y.

[22] Filed: Aug. 28, 1974

[21] Appl. No.: 501,376

[52] U.S. Cl. ..... 340/18 P; 250/263; 328/38; 328/57; 340/18 R; 340/203

[51] Int. Cl.[2] ..... G01V 1/40; G01V 5/00

[58] Field of Search ..... 340/18 P, 203; 328/57, 328/38; 250/261, 262, 263

[56] References Cited

UNITED STATES PATENTS

| | | | |
|---|---|---|---|
| 2,632,847 | 3/1953 | Reed, Jr. | 328/57 |
| 3,165,584 | 1/1965 | Thornton et al. | 328/57 |
| 3,309,657 | 3/1967 | Rabson et al. | 250/262 |
| 3,361,978 | 1/1968 | Fiorini | 328/57 |
| 3,418,604 | 12/1968 | Ross | 328/57 |

*Primary Examiner*—Maynard R. Wilbur
*Assistant Examiner*—H. A. Birmiel
*Attorney, Agent, or Firm*—T. H. Whaley; C. G. Ries; Ronald G. Gillespie

[57] ABSTRACT

A conventional type radiation detector in cooperation with a photomultiplier tube provides data pulses of one polarity, corresponding in peak amplitude and number to detected radiation in a borehole traversing an earth formation. Each data pulse is effectively converted to two pulses of different polarities, with one pulse starting when the other is completed and transmitted over a common well logging cable. The creation of a second pulse of an opposite polarity cancels out the low frequency component of the pulse so that they arrive at the surface as a pulse of a single polarity having a very short tail and a fast rise time. This permits more pulses to be transmitted within a given time period than heretofore existed. Surface electronics process the transmitted pulses to provide a record of the sensed condition in the borehole.

27 Claims, 8 Drawing Figures

MEANS AND METHOD FOR TRANSMITTING A HIGH COUNT RATE PULSE SIGNAL OVER A COMMON WELL LOGGING CABLE

BACKGROUND OF THE INVENTION

Field of the Invention

The method and system of the present invention relates to well logging methods and systems in general and, more particularly, to a nuclear well logging system and method.

SUMMARY OF THE INVENTION

A well-logging system which provides an output corresponding to a condition sensed in a borehole comprises a logging instrument which includes a sensor sensing the condition and providing data pulses. The data pulses are of one polarity and correspond in number and peak amplitude to the sensed condition. A network delays the data pulses for a predetermined time interval. A pulse circuit receiving the data pulses and the delayed data pulses provides a pair of pulses for each data pulse. The pulses in each pair of pulses corresponds to a data pulse and are of opposite polarities. One pulse of each pair of pulses starts upon the completion of the other pulse in the pair of pulses. A transmissive system comprises a cable connected between said logging instrument and surface electronics. The logging instrument also includes another circuit for applying the pairs of pulses from the pulse circuit to one end of the transmission system. The surface electronics includes a network for receiving the pulses transmitted by way of the cable. An output circuit connected to the receiving network provides the output corresponding to the sensed condition in accordance with the received pulses from the receiving network.

The objects and advantages of the invention will appear hereafter from a consideration of the detailed description which follows, taken together with the accompanying drawings, wherein one embodiment of the invention is illustrated by way of example. It is to be expressly understood, however, that the drawings are for illustration purposes only and are not to be construed as defining the limits of the invention.

DESCRIPTION OF THE INVENTION

One problem in the well logging industry is transmitting data pulses, which correspond in number and peak amplitude to a sensed condition, at a high count rate.

The count rate of downhole sensing systems are limited to a degree by the cable employed in transmitting the pulses from downhole to surface electronics.

One attempt to avoid this problem is described and disclosed in U.S. application Ser. No. 192,883 which was filed on Oct. 27, 1971 and assigned to Texaco Inc., assignee of the invention. In the aforementioned application, the inventors resorted to a unique method of pulse transmission over an armored coaxial cable. However, this necessitates that a company, utilizing the technique, replaces a standard logging cable with the special armored coaxial cable.

Figure 1:
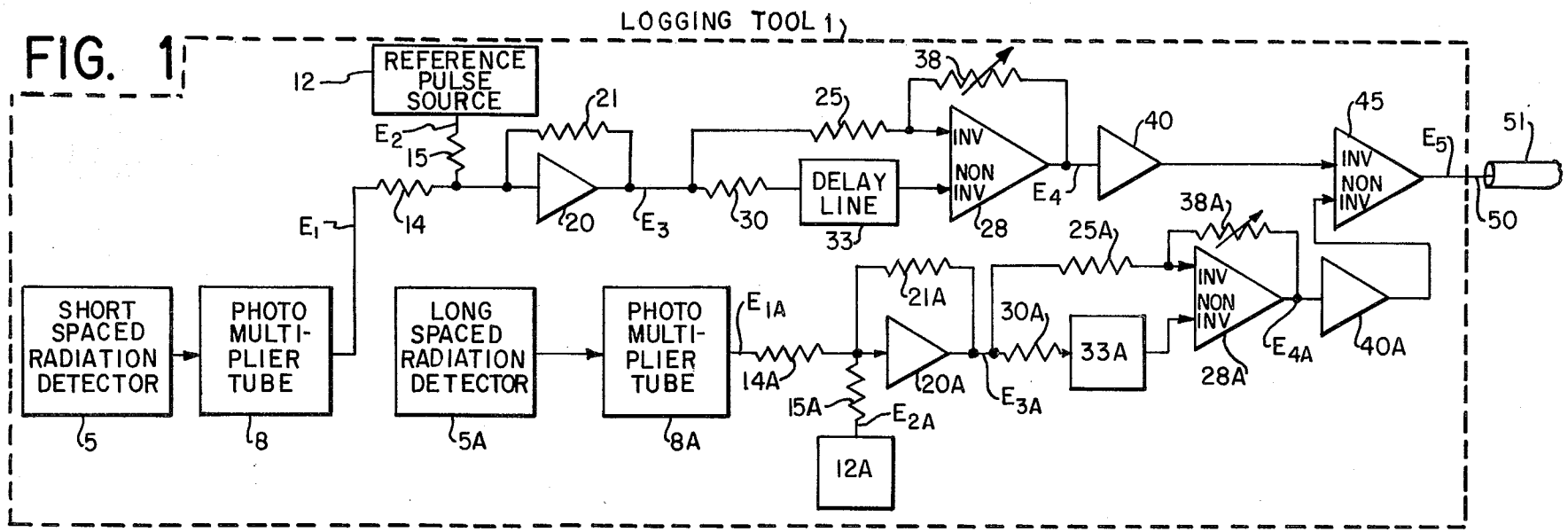
FIG. 1 is a simplified block diagram of a logging tool constructed in accordance with the present invention for providing high count rate pulses to a conventional type logging cable.

The logging system of the present invention does not require a special logging cable to avoid or reduce the problem of the limiting effect of pulse transmission of a standard cable on the pulse count rate. Referring to FIG. 1, there is shown a logging tool 1 adapted to be passed through boreholes traversing earth formations and which includes standard radiation detection means shown arranged in a dual spaced configuration. A short spaced radiation detector 5 may be of a type such as sodium iodide thallium activated or cesium iodide or neutron sensitive detectors such as $He_3$ or Boron Thifluoride detectors or germanium lithium drifted detectors which are furnished with appropriate cooling.

The neutron source for bombarding the earth formation surrounding the borehole is not shown for convenience. The neutron source may be plutonium beryllium (PuBe) or Americium (AmBe). The source might also be a gamma ray source such as cobalt (Co 60) or cesium (Cs 137).

Detector 5 detects radiation emitted by the earth formation resulting from the natural isotopes of the earth formation or from neutron or gamma bombardment of the earth formation which is well known in the art. However, it is not necessary for one skilled in the art to know the particular source of radiation or detection of radiation in order to understand the present invention.

Radiation detector 5, when it is sodium iodide thallium activated or cesium iodide, provided light pulses, corresponding in number and peak amplitude to detected gamma radiation, to a photomultiplier tube 8 which converts the light pulses to electrical data pulses $E_1$. Data pulses $E_1$ correspond in number and peak amplitude to the detected gamma radiation.

A reference pulse source 12 provides large amplitude reference pulses $E_2$ as hereinafter explained. Reference pulses $E_2$ amplitudes are so great with respect to data pulses $E_1$ amplitudes that surface electronics can distinguish between the two types of pulses by amplitude as hereinafter explained. Data pulses $E_1$ and reference pulses $E_2$ are provided to a summing network including summing resistors 14, 15 which are connected to the input of an operational amplifier 20 having a feedback resistor 21 connecting its input to its output. Operational amplifier 20 provides a pulse signal $E_3$ containing the amplified data and reference pulses. The repetition rate of reference pulse $E_2$ should be such as to reduce the probability of a simultaneous occurrence of a data pulse $E_1$ and a reference pulse $E_2$ thereby minimizing any resulting error.

At this point, pulses $E_3$ could be transmitted up-hole. However, in order to permit the use of a conventional type logging cable and reduce the possibility of pulse pile up, pulse signal $E_3$ is processed as follows. Pulse signal $E_3$ is applied through an input resistor 25 to the inverting input of an amplifier 28.

Figure 3A:
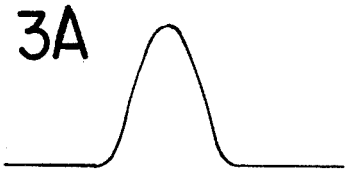
FIGS. 3A and 3B are diagrammatic representation of pulse occurring during operation of the logging tool shown in FIG. 1.

Pulse signal $E_3$ is also applied through another input resistor 30 to a conventional delay line 33. Delay line 33 delays pulse signal $E_3$ for a predetermined time delay. In one instance it has been determined that a time delay of 50 nanoseconds was sufficient for the purposes intended. The delayed pulse is applied to a non-inverting input of amplifier 28 so that the amplifier 28 provides a pulse signal $E_4$ having the shape shown in FIG. 3B. The purpose of delaying pulse $E_3$ before applying it to the non-inverting input of amplifier 28 is to obtain a pair of pulses $E_4$ similar to that shown in FIG. 3B for each pulse $E_3$, shown in FIG. 3A. A variable feedback resistor 38 is used to trim the gain of the positive pulse of the pairs of pulses $E_4$ so as to avoid over shoot or under shoot of the pulses when they reach the surface electronics. It should be noted that delay line 33 may be connected to the inverting input of amplifier 28 with the output of amplifier 20 being connected to the non-inverting input of amplifier 28, and still achieve similar pairs of pulses $E_4$.

Figure 3B:
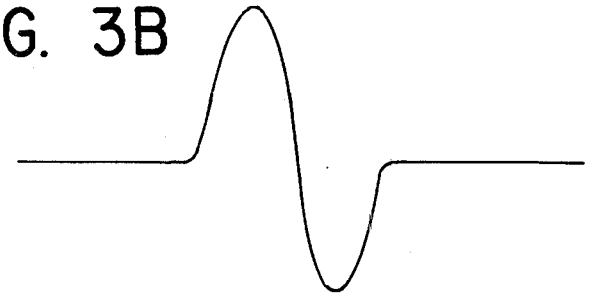
Figure 4A:
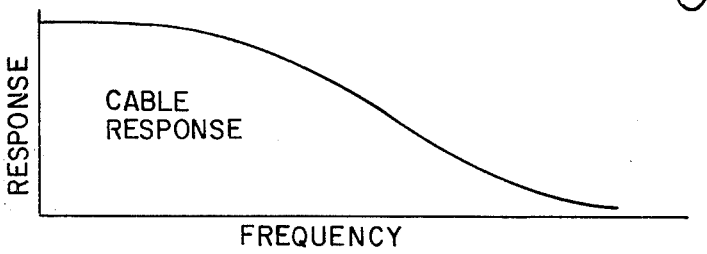
FIGS. 4A through 4C are diagrammatic representations of Fourier Analyses of the cable response, for all frequencies, for a single polarity pulse and for a dual polarity pulse, respectively.

It has been determined that in providing pulses of the shape shown in FIG. 3B that the low frequency components of the pulses $E_3$ are in effect eliminated. This can be seen from FIGS. 4A through 4C. FIG. 4A is a frequency response plot for a conventional type well logging cable.

Figure 4B:
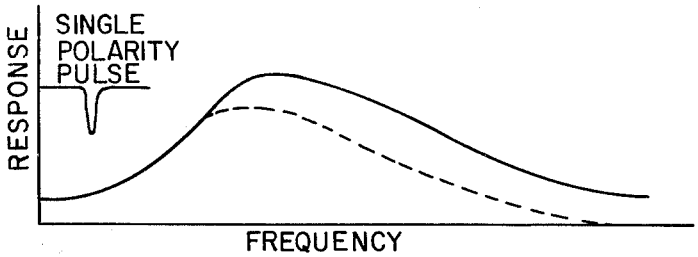

The solid line in FIG. 4B is a plot of the Fourier Analysis of the frequencies that compose a single polarity pulse. The dotted line in FIG. 4B is a plot of the product of the single polarity pulse solid line plot and the cable response plot.

Figure 4C:
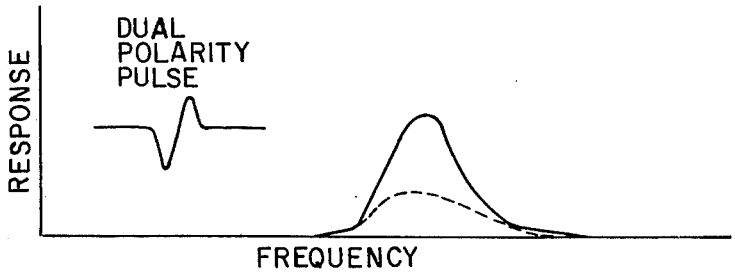

The solid line in FIG. 4C is a plot of the Fourier Analysis of the frequencies that compose a dual polarity pulse, i.e. a pair of pulses having opposite polarities and a predetermined amplitude relationship to each other, one pulse of the pair starting upon completion of the other pulse of the pair. The dotted line in FIG. 4C is a plot of the product of the dual polarity pulse solid line plot and the cable response plot.

Pulses $E_4$ are further amplified by an amplifier 40. At this point the output from amplifier 40 may be applied to a conductor of a conventional logging cable. Transmitting the pulses in such a manner as just described increases the maximum number of pulses per second that may be transmitted.

To continue with the remainder of the system, the elements identified with a number having a suffix A are similar in type and operation as elements having the same numeric designation without suffix A. Elements having the suffix A as part of their designation comprise another channel for transmitting pulses derived from a long spaced radiation detector 5A. Long space radiation detector 5A provides light pulses to a photo multiplier tube 8A which in turn provides data pulses $E_{1A}$ to a summing network receiving reference pulses $E_{2A}$ from a reference pulse source 12A. The summing network includes summing resistors 14A and 15A, an operational amplifier 20A with a feedback resistor 21A. Amplifier 20A provides pulse signal $E_{3A}$ to input resistors 25A and 30A. Resistor 25A is connected to an inverting input of an amplifier 28A while resistor 30A is connected to a non-inverting input amplifier 28A to delay line 33A. A variable feedback resistor 38A is connected to the input and output of amplifier 28. The pulse signal from amplifier 28 is applied to an amplifier 40A.

An amplifier 45 receives the amplified pulses from amplifier 40 at its inverting input and the amplified pulses from amplifier 40A at its non-inverting input which effectively combine the two sets of pulses into a single pulse signal $E_5$. Pulse signal $E_5$ is applied to a conductor 50 of a conventional logging cable 51.

Figure 2:
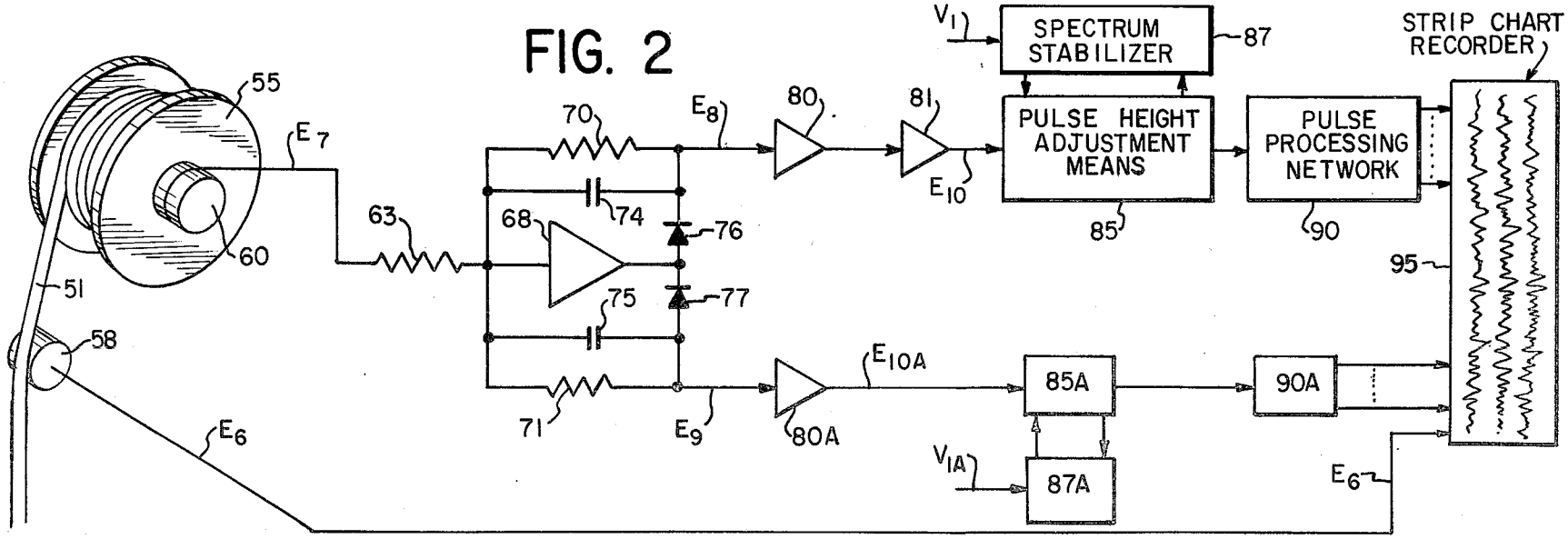
FIG. 2 is a simplified block diagram of surface electronics for processing the pulses transmitted from the logging tool shown in FIG. 1.

Referring now to FIG. 2, cable 51 is wound on a reel 55 and passes over depth measuring means 58 which provides a signal corresponding to the movement of cable 51 and hence to the depth of the logging tool 1 in the borehole. Reel 55 has slip rings 60 connected to the conductors of cable 51 for the conduction of signals and voltages from surface electronics to conductors of cable 51. Signal $E_5$ is picked off of conductor 50 in cable 51 by slip ring 60 which provides it as signal $E_7$ to an input resistor 63 connected to an amplifier 68. Amplifier 68 has associated with it resistors 70, 71, capacitors 74, 75 and diodes 76, 77. Resistor 70 and capacitor 74 are connected to the input of amplifier 68 and to the output of amplifier 68 through diode 76. Diode 76 is connected to amplifier 68 in a manner so that when amplifier 68 provides a positive pulse, diode 76 provides a low resistance to the positive pulse and in effect connects resistor 70, capacitor 74 to the output of the amplifier 68 so that they affect the amplification of the input pulse to amplifier 68. Meanwhile, the input of amplifier 68 is also connected to capacitor 75 and resistor 71 which in turn are connected to diodes 76, 77 and to the output of amplifier 68. During the occurrence of a positive pulse from amplifier 68, diode 77 has a high resistance value so as to not connect resistor 71 and capacitor 75 to the output of amplifier 68.

Similarly, when amplifier 68 provides a negative pulse, diode 76 disconnects resistor 70 and capacitor 74 from the output of amplifier 68 while diode 77 connects resistor 71 and capacitor 75 to the output of amplifier 68. In effect the pulses in pulse signal $E_7$ are separated by polarity to provide a pulse signal $E_8$ having positive pulses at the common junction of resistor 70, capacitor 74 and diode 76 and another pulse signal $E_9$ having negative pulses, is provided at the common junction of resistor 71, capacitor 75 and diode 77.

Pulse signal $E_8$ is amplified by another amplifier 80 and the amplified pulse signal is inverted by an inverting amplifier 81 before being applied to pulse height adjustment means 85.

Means 85 provides a signal to a spectrum stabilizer 87. Stabilizer 87 controls means 85 with a control signal to adjust the amplitude of the pulses provided by inverting amplifier 81 in accordance with the reference pulses in pulse signal $E_{10}$. Means 85 is described in detail in the aforementioned U.S. application Serial No. 192,883 and includes elements 55, 53, 58, 61, 66 and 67 as disclosed in that application. Stabilizer 87 receives a reference voltage $V_1$ to provide the control signal to adjustment means 85. Stabilizer 87 may be of a type NC 20 manufactured by the Harshaw Chemical Company. The pulses provided by adjustment means 85 are applied to a pulse processing network 90 which may be of the type described in the aforementioned U.S. application Ser. No. 192,883. The outputs from pulse processing network 90 are applied to a strip chart recorder 95 which is driven by signal $E_6$. Similarly pulse signal $E_9$ is processed by amplifier 80A, pulse height adjustment means 85A, a spectrum stabilizer 87A receiving a direct current voltage $V_{1A}$ and providing an output to a pulse processing network 90A. Pulse process network 90A provides outputs to strip chart recorder 95. Since the pulses in pulse signal $E_9$ are of a correct polarity there is no need to have an inverting amplifier similar to amplifier 81.

Figure 5:
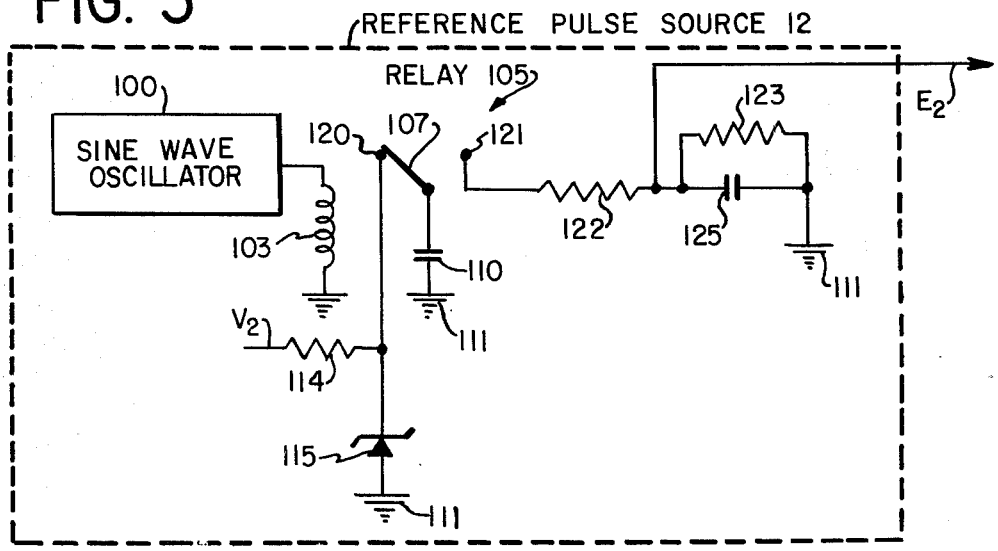
FIG. 5 is a detailed schematic of the reference pulse source shown in FIG. 1.

Referring now to FIG. 5, there is shown reference pulse source 12 which includes a conventional type sine wave oscillator 100 providing a voltage which alternately energizes and de-energizes a coil 103 of a relay 105. Relay 105 includes a pole 107, connected to a capacitor 110, which in turn is connected to ground 111. A direct current voltage $V_2$ is applied to a resistor 114 which is connected to a voltage regulating diode 115 which is also connected to ground 111 and to one contact 120 of relay 105. Another contact 121 of relay 105 is connected to a resistor 122 and to a resistor capacitor network including a resistor 123 and a capacitor 125. In response to the energizing and de-energizing of coil 103, pole 107 will alternately apply voltage $V_2$ to capacitor 110 so that capacitor 110 stores $V_2$ and then swing over and pass the stored voltage from capacitor 110 to contact 121 so that a pulse will appear at contact 121. The pulse at contact 121 of relay 105 passes through resistor 122 to be provided as reference pulse $E_2$, a resistor 123 and a capacitor 125, connected in parallel, connects resistor 122 to ground 111.

Reference pulse source 12 is not respected to the source just described but may also be any type of a highly stabilized reference pulse source. Another suitable reference pulse source may be of the type described and disclosed in a U.S. application Ser. No. 333,074 filed Feb. 16, 1974 and assigned to Texaco Inc.

The system and method of the present invention as heretofore described, provides for increasing the number of pulses which may be transmitted up-hole from a logging instrument in a borehole in a time interval by operation on each pulse to provide a pair of pulses for each pulse corresponding to a detection. The system and method further provide for the dual spectra logging system utilizing a long space and a short space detector.

Further, the invention is not limited to a nuclear well logging system but is applicable to any logging system where information is transmitted up-hole in the form of pulses which correspond to the information in number and peak amplitude. The utilization of the present invention reduces pulse pile up. The system and method of the present invention is not restricted to use with a conventional logging cable. It may be used with any type of electrical cable.

What is claimed is:

1. A well logging system for providing an output corresponding to a condition sensed in a borehole, comprising a logging instrument including sensing means for sensing the condition and providing data pulses of one polarity, corresponding in number and peak amplitude to the sensed condition, means connected to said sensing means for delaying each data pulse for a predetermined time interval to provide a corresponding delayed data pulse, pulse means connected to the delaying means and to the sensing means for providing a pair of pulses for each data pulse and corresponding thereto in accordance with the data pulse and its corresponding delayed data pulse, one pulse of each pair of pulses being of one polarity while the other pulse starts upon completion of the one pulse and is of an opposite polarity, a transmission system comprising a cable connected to said logging instrument; said logging instrument further includes means for applying the pairs of pulses from said pulse means to one end of said transmission system; and surface electronics adjacent to the borehole comprises means coupled to the other end of said transmission system for receiving said pulses transmitted by way of the cable, and means connected to the receiving means for providing the output corresponding to said sensed condition in accordance with the received pulses from the receiving means.

2. A well logging system as described in claim 1 in which the logging instrument further comprises means for providing reference pulses, means connected to the sensing means, to the pulse means and to the reference pulse means for combining the data pulses with the reference pulses and providing a pulse signal having data pulses and reference pulses, to the pulse means; in which the delaying means connects the combining means to the pulse means and provides a delayed pulse signal to the pulse means, and the pulse means provides a pair of pulses for each pulse in the pulse signal; and the surface electronics further comprises compensating means connected to the receiving means for compensating said pulses provided by the receiving means in accordance with the received pulses corresponding to the reference pulses to provide compensated pulses to the output means.

3. A system as described in claim 2 in which the compensating means include adjusting means connected to the receiving means and to the output means for changing the amplitude of the pulses from the receiving means in accordance with a control signal to provide the compensated pulses, and comparing means connected to the adjusting means and receiving a direct current reference voltage for comparing the received pulses corresponding to the reference pulses with the reference voltage and providing a direct current voltage to the adjusting means as the control signal in accordance with the comparison.

4. A system as described in claim 3 in which the pulse means includes an amplifier having an inverting input, a non-inverting input and an output, one input of the two inputs being connected to the combining means and receiving the pulse signal from the combining means, the other input of the two inputs being connected to the delaying means and receiving the delayed pulse signal from the delaying means, the output being connected to the applying means and providing the pairs of pulses to the applying means, and a variable resistor connected between an input and the output to control the amplification of the signal received by that input.

5. A well logging system for providing at least one output corresponding to a condition sensed in a borehole comprising a logging instrument including at least two sensing means for sensing said condition and each sensing means providing data pulses corresponding in number and peak amplitude to said sensed condition, means connected to each sensing means for delaying each data pulse for a predetermined time interval to provide a corresponding delayed data pulse, means connected to each sensing means and to a corresponding delaying means for providing a pair of pulses for each data pulse from the sensing means and corresponding thereto in accordance with the data pulse and its corresponding delayed data pulse, one pulse of the pair of pulses being of one polarity while the other pulse starts upon completion of the one pulse and is of an opposite polarity; a transmission system comprising a cable connected between said logging instrument and surface electronic adjacent to the borehole, said logging instrument further includes means for applying the pairs of pulses to one end of said transmission system; said surface electronics comprising receiving means coupled to the other end of said transmission system for receiving said pulses transmitted by way of the cable, and means connected to the receiving means for providing at least one output corresponding to the sensed condition in accordance with the received pulses from the receiving means.

6. A well logging system as described in claim 5 in which the logging instrument further comprises means for providing reference pulses, means connected to the reference pulse means and to each sensing means for combining the data pulses with the reference pulses to provide one pulse signal, having data pulses and reference pulses, for each sensing means; means connected to the combining means for delaying each pulse signal for a predetermined time interval, means connected to the delaying means and to the combining means for providing the pairs of pulses as pulse signals on a one-to-one basis for the pulse signals from the combining means being so provided, and the surface electronics further includes compensating means connected between said receiving means and said output means for adjusting the amplitudes of said received pulses from the receiving means in accordance with the received pulses corresponding to the reference pulses to provide compensated pulses to the output means.

7. A system as described in claim 6 in which each pulse means includes an amplifier having an inverting input, a non-inverting input and an output, one input of the two inputs being connected to a corresponding combining means and receiving the pulse signal from the combining means, the other input of the two inputs being connected to a corresponding delaying means and receiving the delayed pulse signal from the delaying means, the output being connected to the applying means and providing the pairs of pulses to the applying means; and a variable resistor connected between an input and the output to control the amplification of the signal received by that input.

8. A well logging method for providing an output corresponding to a condition sensed in a borehole, which comprises the steps of sensing the condition in the borehole, providing data pulses of one polarity, corresponding in number and peak amplitude to the sensed condition, delaying each data pulse for a predetermined time interval to provide a corresponding delayed data pulse, providing a pair of corresponding pulses for each data pulse in accordance with the data pulse and its corresponding delayed data pulse, one pulse of each pair of pulses being of one polarity while the other pulse starts upon completion of the one pulse and is of an opposite polarity, transmitting the pairs of pulses uphole by way of a cable, receiving at the surface said pulses transmitted by way of the cable, and providing the output corresponding to said sensed condition in accordance with the received pulses.

9. A well logging method as described in claim 8 which further comprises the steps of providing reference pulses in the borehole, combining the data pulses with the reference pulses in the borehole to provide a pulse signal having data pulses and reference pulses; in which the delaying step includes delaying the pulse signal, and the step of providing pairs of pulses includes providing a pair of pulses for each pulse in the pulse signal; and which further comprises the step of compensating received pulses at the surface in accordance with the received pulses corresponding to the reference pulses to provide compensated pulses.

10. A method as described in claim 9 in which the compensating step includes changing the amplitude of the received pulses in accordance with a control signal to provide the compensated pulses, and comparing the receiving pulses corresponding to the reference pulses in the compensated pulses with the reference voltage, and providing a direct current voltage as the control signal in accordance with the comparison.

11. A method as described in claim 10 in which the step of providing the pairs of pulses includes inverting the pulse signal, and amplifying the inverted pulse signal and the delayed pulse signal simultaneously to provide the pairs of pulses.

12. A method as described in claim 10 in which the step of providing the pairs of pulses includes inverting the delayed pulse signal, and amplifying the inverted delayed pulse signal and the pulse signal simultaneously to provide the pairs of pulses.

13. A well logging method for providing at least one output corresponding to a condition sensed in a borehole comprising the steps of simultaneously sensing said condition at two different locations in the borehole, providing at least two sets of data pulses corresponding in number and peak amplitude to said sensed condition, delaying each data pulse in each set for a predetermined time interval to provide a corresponding delay data pulse, providing pulse signals, each pulse signal having a pair of pulses for each data pulse and representative thereof in a corresponding set of data pulses in accordance with the data pulse and its corresponding delayed data pulse, one pulse of the pair being of one polarity while the other pulse starts upon completion of the one pulse and is of an opposite polarity, applying the pulse signals to one end of an electrical conductive cable for transmission uphole, receiving said pulses transmitted by way of the cable, and providing at least one output corresponding to the sensed condition in accordance with the received pulses.

14. A well logging method as described in claim 13 further comprising the step of providing reference pulses in the borehole, combining the data pulses with the reference pulses to provide one pulse signal, having data pulses and reference pulses, for each sensing of the condition; delaying each pulse signal for a predetermined time interval, providing the pairs of pulses as pulse signals on a one-to-one basis with the pulse signals provided by the combining step, adjusting the amplitude of said received pulses in accordance with the received pulses corresponding to the reference pulses to provide compensated pulses, and providing the output corresponding to the sensed condition in accordance with the compensated pulses.

15. A circuit adapted to receive a pulse for providing a pair of output pulses for each received pulse, comprising means for receiving pulses and providing the received pulses, means connected to the receiving means for delaying each received pulse provided by the receiving means for a predetermined time interval to provide a corresponding delay received pulse, and means connected to the receiving means and to the delaying means for providing the pairs of pulses for each received pulse in accordance with the received pulse and its corresponding delayed received pulse in a manner so that one pulse of each pair of pulses has one polarity while the other pulse of each pair of pulses starts upon completion of the one pulse and has an opposite polarity, and further wherein the means providing the pairs of pulses include an amplifier having an inverting input, a non-inverting input and an output, one of the inputs being connected to the receiving means, the other input being connected to the delaying means, so that the amplifier provides a pair of pulses at the output when the receiving means provides a received pulse, and a variable resistor is connected between an input and the output of the amplifier so as to control the amplification of the signal received by that input.

16. A method for preparing pulses for transmission over a well logging cable, comprising providing a pair of output pulses which comprises the steps of receiving pulses, delaying the received pulses for a predetermined time interval, providing a pair of pulses for each received pulse in accordance with the received pulse and the corresponding delayed received pulse in a manner so that one pulse of the pair of pulses has one polarity while the other pulse starts upon completion of the one pulse and has an opposite polarity, and applying the pair of pulses to the well logging cable.

17. A method as described in claim 16 in which the means providing the pairs of pulses step include inverting each received pulse, and amplifying each inverted received pulse and its corresponding delayed received pulse simultaneously to provide the pairs of pulses.

18. A method as described in claim 16 in which the providing the pairs of pulses step includes inverting each delayed received pulse, and amplifying each inverted delay received pulse and its corresponding received pulse simultaneously to provide the pairs of pulses.

19. A nuclear well logging system for providing an output corresponding to a condition sensed in a borehole, comprising a logging instrument including detecting means responsive to penetration radiation in the borehole for providing data pulses of one polarity, corresponding in number and peak amplitude to the detected penetration radiation means connected to said detecting means for delaying each data pulse for a predetermined time interval to provide a corresponding delayed data pulse, pulse means connected to the delaying means and to the detecting means for providing a pair of pulses for each data pulse and corresponding thereto in accordance with the data pulse and its corresponding delayed data pulse, one pulse of each pair of pulses being of one polarity while the other pulse starts upon completion of the one pulse and is of an opposite polarity, a transmission system comprising a cable connected to said logging instrument; said logging instrument further includes means for applying the pairs of pulses from said pulse means to one end of said transmission system; and surface electronics adjacent to the borehole comprises means coupled to the other end of said transmission system for receiving said pulses transmitted by way of the cable, and means connected to the receiving means for providing the output corresponding to said sensed condition in accordance with the received pulses from the receiving means.

20. A nuclear well logging system as described in claim 19 in which the logging instrument further comprises means for providing reference pulses, means connected to the detecting means, to the pulse means and to the reference pulse means for combining the data pulses with the reference pulses and providing a pulse signal having data pulses and reference pulses, to the pulse means; in which the delaying means connects the combining means to the pulse means and provides a delayed pulse signal to the pulse means, and the pulse means provides a pair of pulses for each pulse in the pulse signal; and the surface electronics further comprises compensating means connected to the receiving means for compensating said pulses provided by the receiving means in accordance with the received pulses corresponding to the reference pulses to provide compensated pulses to the output means.

21. A nuclear well logging system as described in claim 20 wherein the penetration radiation is neutron-induced gamma radiation.

22. A nuclear well logging system as described in claim 20 wherein the penetration radiation is natural gamma radiation.

23. A nuclear well logging method for providing an output corresponding to a condition sensed in a borehole, which comprises the steps of detecting penetration radiation in the borehole, providing data pulses of one polarity, corresponding in number and peak amplitude to the detected penetration radiation, delaying each data pulse for a predetermined time interval to provide a corresponding delayed data pulse, providing a pair of corresponding pulses for each data pulse in accordance with the data pulse and its corresponding delayed data pulse, one pulse of each pair of pulses being of one polarity while the other pulse starts upon completion of the one pulse and is of an opposite polarity, transmitting the pairs of pulses uphole by way of a cable, receiving at the surface said pulses transmitted by way of the cable, and providing the output corresponding to said sensed condition in accordance with the received pulses.

24. A nuclear well logging method as described in claim 23 which further comprises the steps of providing reference pulses in the borehole, combining the data pulses with the reference pulses in the borehole to provide a pulse signal having data pulses and reference pulses; in which the delaying step includes delaying the pulse signal, and the step of providing pairs of pulses includes providing a pair of pulses for each pulse in the pulse signal; and which further comprises the step of compensating received pulses at the surface in accordance with the received pulses corresponding to the reference pulses to provide compensated pulses.

25. A nuclear well logging method as described in claim 24 wherein the detected penetration radiation is neutron-induced gamma radiation.

26. A nuclear well logging method as described in claim 24 wherein the detected penetration radiation is natural gamma radiation.

27. A nuclear well logging system for providing an output corresponding to a condition sensed in a borehole, comprising a logging instrument including detecting means responsive to penetration radiation in the borehole for providing data pulses of one polarity, corresponding in number and peak amplitude to the detected penetration radiation, and reference pulses of a predetermined amplitude, means connected to said detecting means for delaying the pulses for a predetermined time interval, pulse means connected to the delaying means and to the detecting means for providing a pair of pulses for each pulse from the detecting means and corresponding thereto in accordance with the pulse from the detecting means and its corresponding delayed pulse, one pulse of each pair of pulses being of the one polarity while the other pulse starts upon completion of the one pulse and is of an opposite polarity; a transmission system comprising a cable connected to said logging instrument; said logging instrument further includes means for applying the pairs of pulses from said pulse means to one end of said transmission system; and surface electronics adjacent to the borehole comprises means coupled to the other end of said transmission system for receiving said pulses transmitted by way of the cable, and means connected to the receiving means for providing the output corresponding to said sensed condition in accordance with the received pulses from the receiving means.

* * * * *